US011066962B1

(12) United States Patent
Newell et al.

(10) Patent No.: US 11,066,962 B1
(45) Date of Patent: Jul. 20, 2021

(54) ENGINE VALVE ACTUATION SYSTEM AND LIFTER ARM ASSEMBLY HAVING LIFTER ARM OIL SPRAY PORT FOR CAM-ROLLER LUBRICATION

(71) Applicant: Caterpillar Inc., Peoria, IL (US)

(72) Inventors: Jonathan Richard Newell, Delphi, IN (US); Prabhu Nagaraj, TN (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/927,251

(22) Filed: Jul. 13, 2020

(51) Int. Cl.

| | |
|---|---|
| ***F01M 9/10*** | (2006.01) |
| ***F01L 1/14*** | (2006.01) |
| ***F01L 1/24*** | (2006.01) |
| *F01L 1/245* | (2006.01) |
| *F01L 1/047* | (2006.01) |

(52) U.S. Cl.
CPC ..... *F01L 1/146* (2013.01); *F01L 1/24* (2013.01); *F01M 9/101* (2013.01); *F01L 2001/054* (2013.01); *F01L 2001/2427* (2013.01); *F01L 2001/256* (2013.01); *F01L 2305/00* (2020.05); *F01L 2810/02* (2013.01)

(58) Field of Classification Search
CPC ..... F01L 2001/054; F01L 1/146; F01L 1/46; F01L 2305/00; F01L 2810/02; F01M 9/101
USPC ..... 123/90.34, 90.61
See application file for complete search history.

(56) References Cited

U.S. PATENT DOCUMENTS

| | | | | |
|---|---|---|---|---|
| 2,563,699 | A | 8/1951 | Winter, Jr. | |
| 2,956,642 | A | 10/1960 | Chaplin et al. | |
| 3,881,788 | A | 5/1975 | Kotauczek | |
| 4,245,523 | A | 1/1981 | Wherry | |
| 6,640,779 | B1 | 11/2003 | Thiyagarajan | |
| 2004/0025823 | A1 * | 2/2004 | Snyder | F01L 1/02 123/90.31 |

FOREIGN PATENT DOCUMENTS

| | | | | |
|---|---|---|---|---|
| CN | 204646351 | U | 9/2015 | |
| FR | 2788810 | A1 * | 7/2000 | F01L 1/185 |

* cited by examiner

*Primary Examiner* — Jorge L Leon, Jr.
(74) *Attorney, Agent, or Firm* — Brannon Sowers & Cracraft

(57) ABSTRACT

An engine valve actuation system includes a rotatable camshaft having a cam lobe, and a lifter arm assembly having a lifter arm with a roller in contact with the cam lobe. A bushing is positioned in a pin bore of the lifter arm and journals the lifter arm upon the pin for reciprocation in response to rotation of the camshaft. An incoming oil passage extends to the pin bore, and an outgoing oil passage extends from the pin bore. The outgoing oil passage forms an oil spray port defining an oil spray path oriented to direct a spray of oil at the roller and/or the cam lobe. An oil feed groove is formed in at least one of the lifter arm or the bushing and fluidly connects the incoming oil passage to the outgoing oil passage.

20 Claims, 5 Drawing Sheets

ENGINE VALVE ACTUATION SYSTEM AND LIFTER ARM ASSEMBLY HAVING LIFTER ARM OIL SPRAY PORT FOR CAM-ROLLER LUBRICATION

TECHNICAL FIELD

The present disclosure relates generally to an engine valve actuation system, and more particularly to a lifter arm assembly in an engine valve actuation system where an oil feed groove is formed between a lifter arm and a bushing and supplies a feed of lubricating oil to an oil spray port defining an oil spray path oriented to intersect at least one of a roller or a cam lobe.

BACKGROUND

A wide variety of valve actuation systems are well known and widely used throughout the world in internal combustion engines. A typical engine configuration includes one or more intake valves and one or more exhaust valves each associated with a combustion cylinder in the engine. Over the course of an engine cycle a valve actuation system is used to open and close intake valves to allow a charge of fresh air, and sometimes fresh air mixed with fuel or other gases, to enter a cylinder. Following a combustion or expansion stroke, a valve actuation system is used to open exhaust valves to enable the combustion products to be expelled. Valve opening and closing in an internal combustion engine is generally a very rapid and precisely timed process.

A rotatable camshaft coupled with an engine crankshaft, such as by way of a geartrain, is typically employed to actuate engine valves open, with the valve actuation system converting the rotational motion of the camshaft into linear motion of the engine valves. Devices known as valve lifters are typically coupled between the camshaft and engine valves for this purpose. Valve lifters utilize a roller or other cam follower that contacts the rotating engine camshaft and is moved linearly in response to contact with a non-circular cam lobe. Wear, performance degradation, or other problems are sometimes observed with respect to the various actuation system components that contact and rotate against one another. Various lubrication strategies are employed in an effort to mitigate such phenomena in valve actuation systems. One example engine valve actuation system proposing a design for camshaft and bearing lubrication is set forth in U.S. Pat. No. 2,956,642 to A. Chaplin et al. While the strategy set forth in Chaplin et al. may have various applications, there is always room for improvement and alternative strategies.

SUMMARY OF THE INVENTION

In one aspect, an engine valve actuation system includes a rotatable camshaft having a cam lobe, and a lifter arm assembly including a lifter arm. The lifter arm has a roller end, a roller mounted in the roller end and in contact with the cam lobe, a pin end having an outer surface, and an inner surface forming a pin bore. The lifter arm assembly further includes a pin extending through the pin bore, and a bushing positioned in the pin bore and journaling the lifter arm upon the pin for reciprocation in response to rotation of the camshaft. An incoming oil passage extends through the lifter arm assembly to the pin bore, and an outgoing oil passage extends through the lifter arm from the pin bore. The outgoing oil passage forms an oil spray port in the outer surface and defines an oil spray path that is oriented to intersect at least one of the roller or the cam lobe. An oil feed groove is formed between the lifter arm and the bushing and fluidly connects the incoming oil passage to the outgoing oil passage.

In another aspect, a lifter arm assembly for an engine valve actuation system includes a lifter arm having a roller end with a fork, a roller mounted for rotation in the fork and structured to contact a cam lobe of a rotatable camshaft, a pin end having an outer surface, and an inner surface forming a pin bore defining a center axis, for receiving a pin to support the lifter arm for reciprocation in response to rotation of the camshaft. The lifter arm further has an outgoing oil passage extending through the lifter arm from the pin bore. The outgoing oil passage includes an inlet port opening to the pin bore, and an oil spray port opening in the outer surface and defining an oil spray path from the outer surface oriented to intersect at least one of the roller or the cam lobe. The lifter arm assembly further includes a bushing positioned in the pin bore and held at a fixed angular orientation about the center axis. An oil feed groove is formed between the lifter arm and the bushing and fluidly connects to the outgoing oil passage.

In still another aspect, a lifter arm for an engine valve actuation system includes a lifter arm body having a roller end with a fork structured for mounting a roller that contacts a cam lobe of a rotatable camshaft, and a pushrod lifter having an arcuate rod-contact surface and an upwardly projecting wall extending circumferentially around the arcuate rod-contact surface. The lifter arm body further includes a pin end having an outer surface, and an inner surface forming a pin bore defining a center axis, and a connecting section extending between the roller end and the pin end. An outgoing oil passage is located in the pin end and extends in a radially outward direction from an oil inlet port opening to the pin bore to an oil spray port opening at the outer surface.

DETAILED DESCRIPTION

Figure 1:
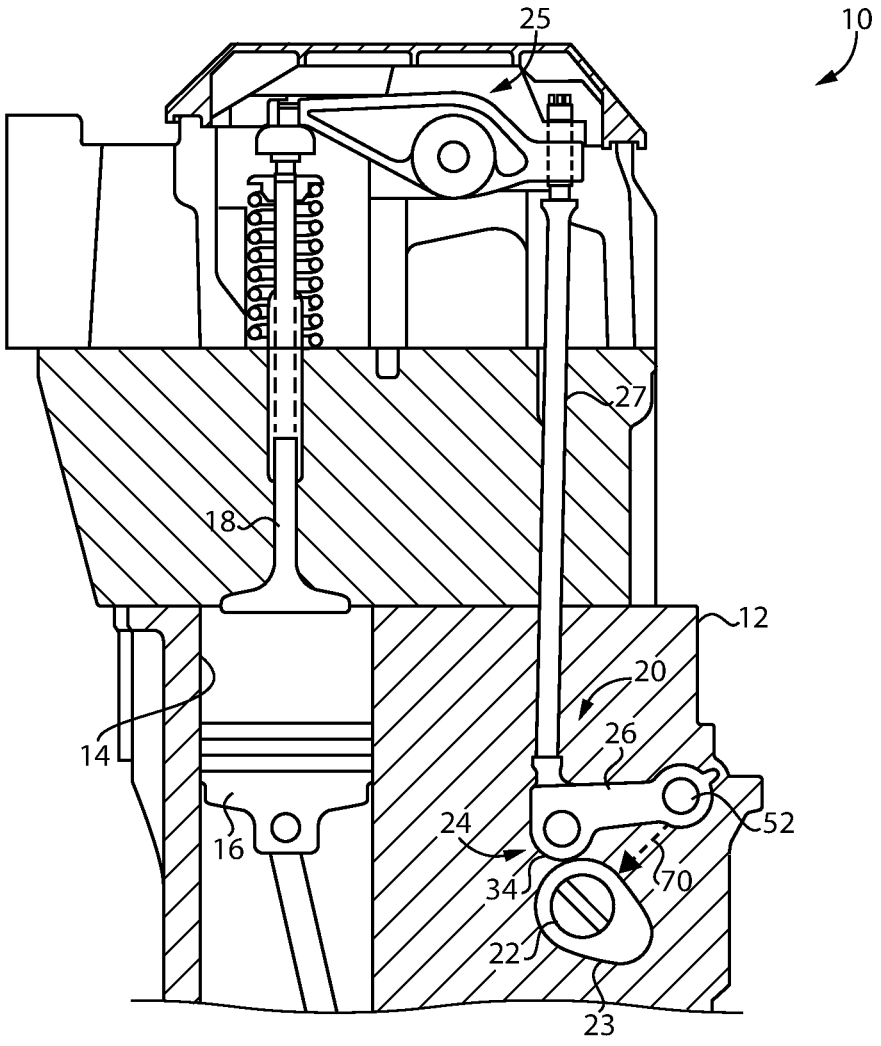
FIG. 1 is a diagrammatic view of an engine system, according to one embodiment.

Referring to FIG. 1, there is shown an internal combustion engine system 10 according to one embodiment. Internal combustion engine system 10 (hereinafter "engine system 10") includes an engine housing 12 having a combustion cylinder 14 formed therein. Engine housing 12 may have any number of combustion cylinders formed therein, in any suitable arrangement such as an inline pattern or a V-pattern, or still another. A piston 16 is movable within cylinder 14 between a top dead center position and a bottom dead center position, typically in a conventional four-stroke engine cycle. An engine valve 18 is shown associated with cylinder 14 and is movable between an open position and a closed position to control fluid connection between cylinder 14 and an intake conduit or an exhaust conduit (not shown). Engine valve 18 may be either of an intake valve or an exhaust valve, and could include one of a plurality of intake valves or one of a plurality of exhaust valves, respectively coupled together by way of a valve bridge or the like. In a practical implementation strategy, engine system 10 can include a direct-injection compression-ignition diesel engine, however, the present disclosure is not thereby limited and engine system 10 could be port-injected, supplied with a premixed charge of fuel and air formed upstream of engine housing 12, be spark-ignited, or have a variety of other configurations or operating capabilities.

Engine system 10 further includes an engine valve actuation system 20 for actuating engine valve 18 between the open position and the closed position. While engine valve actuation system 20 is shown coupled with an engine valve in the nature of a gas exchange valve, in other instances engine valve actuation system 20 could be structured to actuate other valves, including components in a fuel injector, for example. Engine valve actuation system 20 (hereinafter "actuation system 20") includes a rotatable camshaft 22 having a cam lobe 23. Camshaft 22 can be rotated by way of a geartrain (not shown) of engine system 10 and could include any number of cam lobes rotating with camshaft 22 as engine system 10 operates. Actuation system 20 further includes a pushrod 27 coupled with a rocker arm 25 that is in turn coupled with engine valve 18. A lifter arm assembly 24 of actuation system 20 includes a lifter arm 26 structured to lift pushrod 27 to reciprocate rocker arm 25 as camshaft 22 rotates. As will be further apparent from the following description, actuation system 20 is uniquely configured by way of structure of lifter arm assembly 24 for improved lubrication and reduced camshaft/cam lobe scuffing or other wear.

Figure 2:
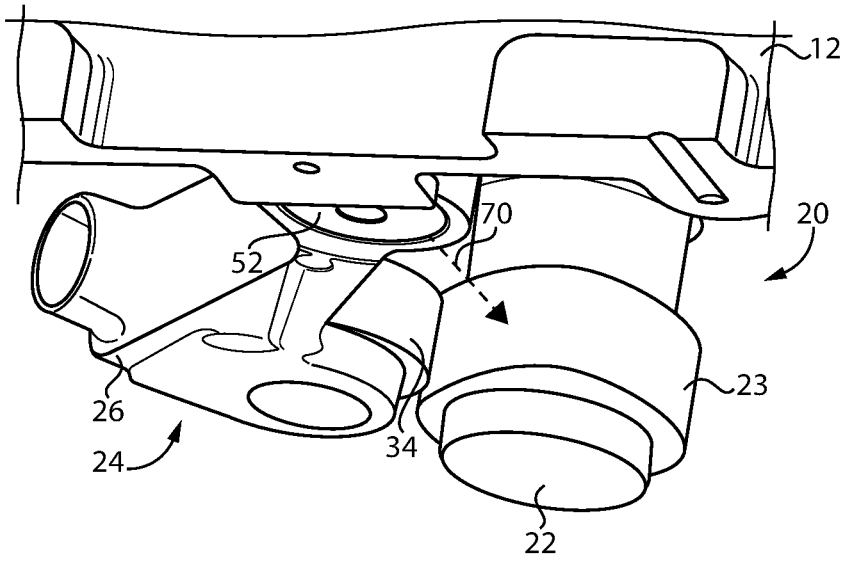
FIG. 2 is a perspective view of an engine valve actuation system for an engine system, according to one embodiment.
Figure 3:
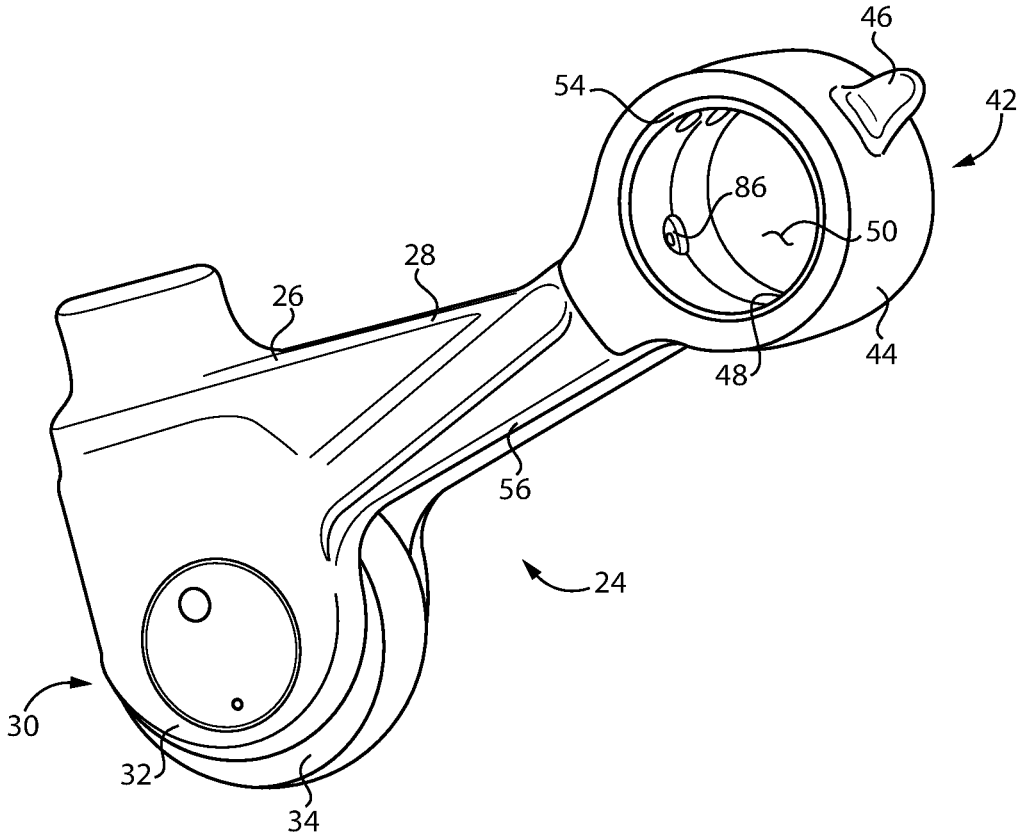
FIG. 3 is a diagrammatic view of a lifter arm assembly, according to one embodiment.
Figure 4:
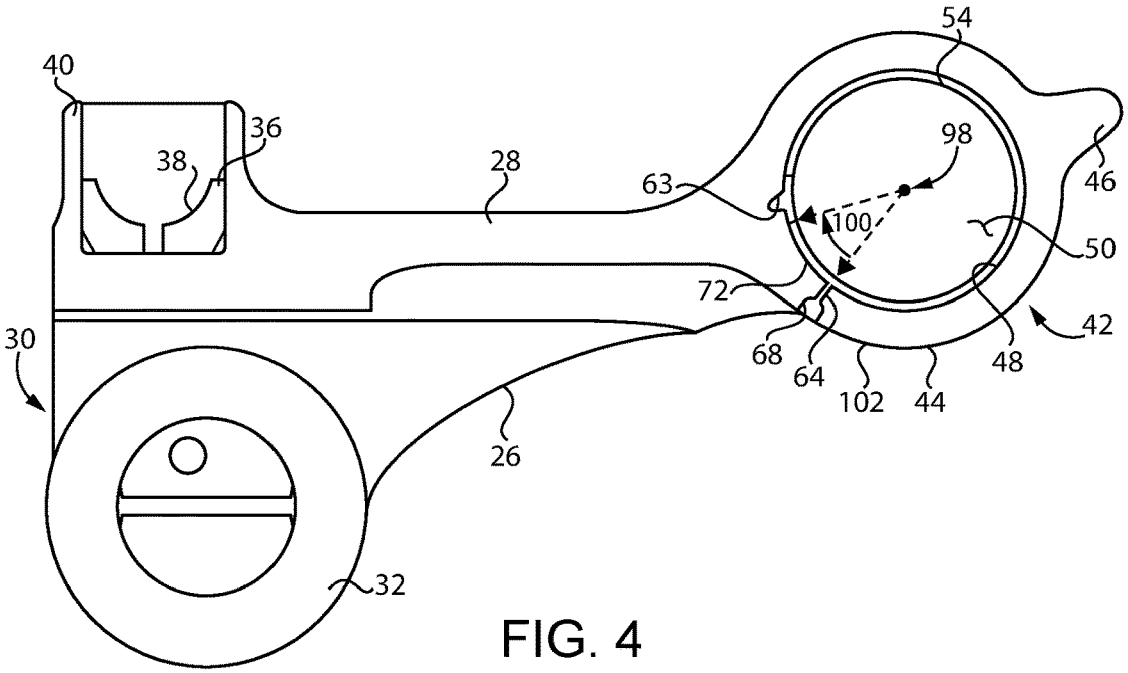
FIG. 4 is a sectioned side diagrammatic view of the lifter arm assembly of FIG. 3.

Referring also now to FIGS. 2-4, there are shown additional features of actuation system 20 in further detail. Lifter arm assembly 24 includes a lifter arm 26 having a lifter arm body 28. Description and discussion herein of either lifter arm 26 or lifter arm body 28 should be understood as interchangeable. Lifter arm 26 includes a roller end 30 having a fork 32 structured for mounting a roller 34, such that roller 34 rotates in contact with cam lobe 23. Roller end 30 further includes a pushrod lifter 36 having an arcuate rod-contact surface 38 contacted by an end of pushrod 27. An upwardly projecting wall 40 extends circumferentially around arcuate rod-contact surface 38.

Lifter arm 26 further includes a pin end 42 having an outer surface 44, and a lug 46 projecting from outer surface 44. Pin end 42 also includes an inner surface 48 forming a pin bore 50. A pin 52 extends through pin bore 50 and may be supported at a fixed angular orientation relative to engine housing 12. A connecting section 56 extends between roller end 30 and pin end 42. Connecting section 56 may be necked down and relatively narrower than roller end 30 and pin end 42 in at least one of a vertical aspect (up and down in FIG. 4) or a horizontal aspect (into and out of the page in FIG. 4) as will be apparent from the drawings. Lifter arm assembly 24 further includes a bushing 54 positioned in pin bore 50 and held at a fixed angular orientation relative to a center axis 98 defined by pin bore 50, such as by interference-fitting. Bushing 54 is structured for journaling lifter arm 26 upon pin 52 for reciprocation in response to rotation of camshaft 22. It will thus be appreciated that camshaft 22 rotates with cam lobe 23 followed by roller 34 to actuate pushrod 27, upward in the illustration of FIG. 1, as an ascending profile of cam lobe 23 contacts roller 34, then permitting pushrod 27 to move downward as a descending profile of cam lobe 23 is followed by roller 34. A valve return spring (not numbered) opposes the upward travel of pushrod 27 and assists in biasing pushrod 27 downward based upon the relative angular orientation of cam lobe 23 in a generally known manner.

Figure 6:
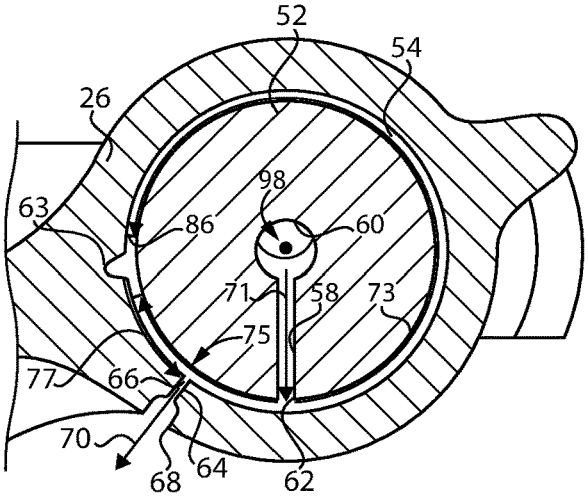
FIG. 6 is a sectioned side diagrammatic view of a portion of the lifter arm assembly of FIGS. 3 and 4.

Referring also to FIG. 6, lifter arm assembly 24 further has an incoming oil passage 58 formed therein that extends through pin 52 from an inlet opening 60, radially outward relative to center axis 98. Incoming oil passage 58 may form an outlet opening 62 that feeds engine oil between pin 52 and bushing 54. From opening 62, oil is conveyed between bushing 54 and pin 52, including through a peripheral and circumferential groove in bushing 54, discussed below, to an opening 86 in bushing 54. From opening 86 oil is conveyed between bushing 54 and inner surface 48, including through an oil feed groove, discussed below. Between bushing 54 and inner surface 48 oil is fed circumferentially around center axis 98 to an outgoing oil passage 64 by a "short path" or a "long path" further discussed herein, and in any event traversing less than 360° around center axis 98. In FIG. 6, arrows 71, 73, and 75, indicate a flow of oil from passage 58 between pin 52 and bushing 54. Arrow 77 indicates a flow of oil between bushing 54 and inner surface 48 by way of the short path to outgoing oil passage 64.

Figure 9:
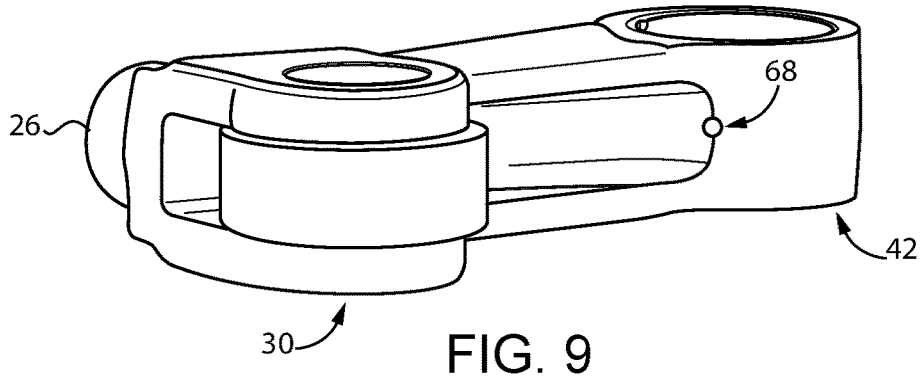
FIG. 9 is a diagrammatic view of a lifter arm, according to one embodiment.

Outgoing oil passage 64 extends through lifter arm 26 from pin bore 50, and includes an inlet port 66 opening to pin bore 50, and also includes and forms an oil spray port 68 in outer surface 44. Oil spray port 68 defines an oil spray path 70 that is oriented to intersect at least one of roller 34 or cam lobe 23. Also in a practical implementation strategy outer surface 44 forms a circular arc 102 around center axis 98, as shown in FIG. 4, and oil spray port 68 is located on the circular arc 102 and oriented such that oil spray path 70 intersects cam lobe 23 as depicted in FIG. 1 and FIG. 2. FIG. 9 shows another view of lifter arm 26 illustrating the example location and orientation of oil spray port 68.

Certain known engine valve actuation systems have been observed to experience cam lobe wear in the nature of scuffing or other damage that can result in performance degradation and/or require premature servicing. The present disclosure reflects the discovery and observation that directly supplying a spray of oil to the interacting cam lobe and/or roller surfaces can be associated with improved lubrication that limits or eliminates entirely the aforementioned problems. A supply pressure of oil into and through incoming oil passage 58 may be such that excess oil pressure drop or insufficient oil flow can be observed where the manner or path of supplying oil to oil spray port 68 is not optimal. Actuation system 20, and lifter arm assembly 24 in particular, may be structured to provide a desired oil flow rate without unduly restricting oil pressure or, alternatively, resulting in excessive oil flow and consumption. To this end, an oil feed groove 72 is formed between lifter arm 26 and bushing 54 to convey oil by way of the path indicated by arrow 77 (or alternatively a "long" path as noted above) and fluidly connects opening 86 in bushing 54 to outgoing oil passage 64. An oil accumulation pocket 63 may be formed in inner surface 48 to coincide with opening 86. Oil feed groove 72 may be formed in lifter arm 26, in bushing 54, or in both, as further discussed herein.

Oil feed groove 72 defines a groove path from a first angular location, relative to center axis 98, and a second angular location of outgoing oil passage 64, also relative to center axis 98. The groove path from the first angular location to the second angular location will typically be less than 360°. FIG. 9 illustrates yet another view of lifter arm 26 where oil spray port 68 can be shown oriented to direct a spray of oil at a roller or cam lobe in actuation system 20. As shown in FIG. 4, the groove path may define a circumferential angle 100 from the first angular location to the second angular location. Circumferential angle 100 in the illustrated embodiment may be between 34° and 66°, corresponding to the short path between opening 86 and outgoing oil passage 64. In an alternative "long path" embodiment, discussed below, the groove path may define a circumferential angle between 66° and 360°. As used herein the term "between" means not inclusive of, thus, between 66° and 360° means less than 360°. It has been discovered that a groove path that is fully circumferential of a bushing in this context could result in reduced or no flow the long way around the bushing, with oil instead taking a short path.

Figure 5:
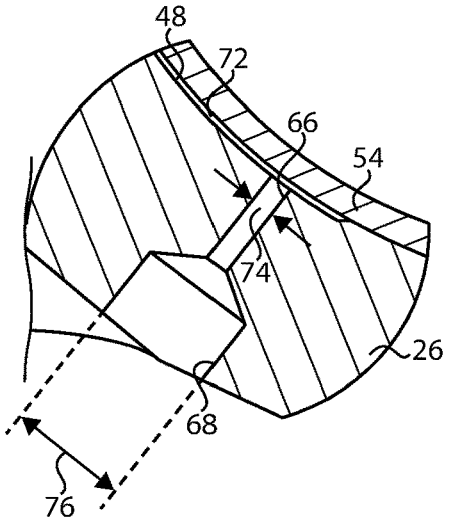
FIG. 5 is a detailed view of a portion of the lifter arm assembly of FIGS. 3 and 4.
Figure 7:
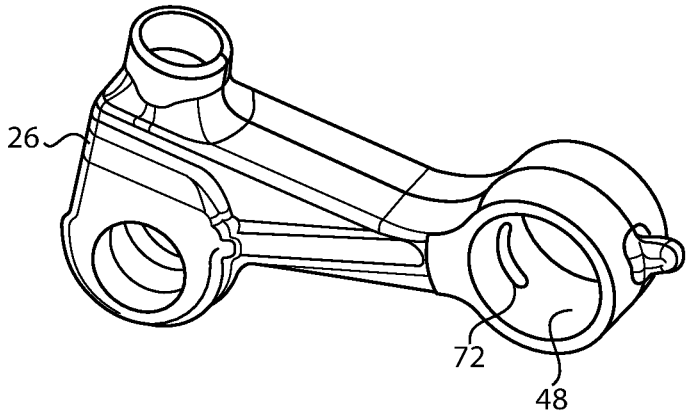
FIG. 7 is a diagrammatic view of a lifter arm, according to one embodiment.

In FIG. 5 it can be seen that oil feed groove 72 extends just past inlet port 66 and is formed in inner surface 48 such that oil feed groove 72 is capped or closed by bushing 54. It will be recalled that an oil feed groove according to the present disclosure could alternatively or additionally be formed in bushing 54 itself. Accordingly, description and discussion herein as to the circumferential extent or other features of oil feed groove 72 in lifter arm 26 can be understood by way of analogy to refer to an oil feed groove in bushing 54. It can also be noted from FIG. 5 that inlet port 66 has a relatively narrower diameter 74, whereas oil spray port 68 has a relatively larger diameter 76. Referring also to FIG. 7, there is shown a 3-dimensional view where the circumferential extent of oil feed groove 72 in inner surface 48 is shown. Oil feed groove 72 can be formed by machining into inner surface 48, and typically at locations that are approximately half-way between lateral sides of lifter arm 26.

Figure 8:
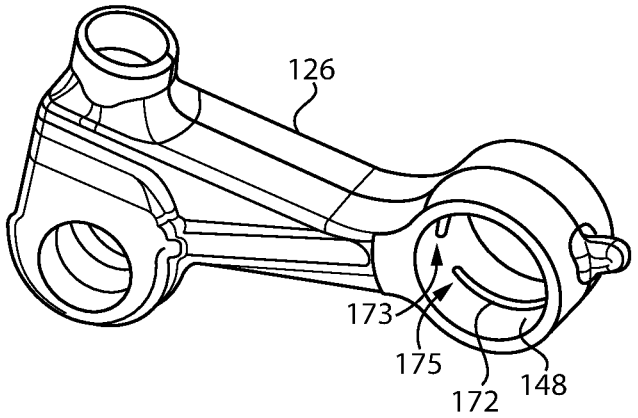
FIG. 8 is a diagrammatic view of a lifter arm, according to another embodiment.

FIG. 8 illustrates an alternative embodiment where an oil feed groove 172 in a lifter arm 126 takes the "long path," less than 360°, around an inner surface 148 in the respective lifter arm 126 between a first groove end 173 and a second groove end 175. It will be appreciated that a bushing (not shown) can be fitted with lifter arm 126, or other lifter arm embodiments contemplated herein, to form the closed groove path with oil feed groove 172 to feed oil to an outgoing oil passage forming an oil spray port in lifter arm 126, located and oriented similarly to other embodiments herein. In variations and extensions of the present disclosure, an incoming oil passage could feed oil to a pin end in a lifter arm by way of a different route, extending through the lifter arm body, for example, and/or an outgoing oil passage could exit the lifter arm at different locations than shown in the present disclosure. In any case, different lifter arm and engine configurations may justify different oil spray exit locations, different internal oil passage plumbing or other modifications. Providing an oil feed groove in any of the embodiments that is formed by a lifter arm and/or a bushing can provide a labyrinthine flow path enabling flow rates and oil pressure drop considerations to be balanced more readily than efforts at tightly specifying the sizes of ports, passages, or other features, for example, often having tolerances that can be difficult to control with very small sizes.

Figure 10:
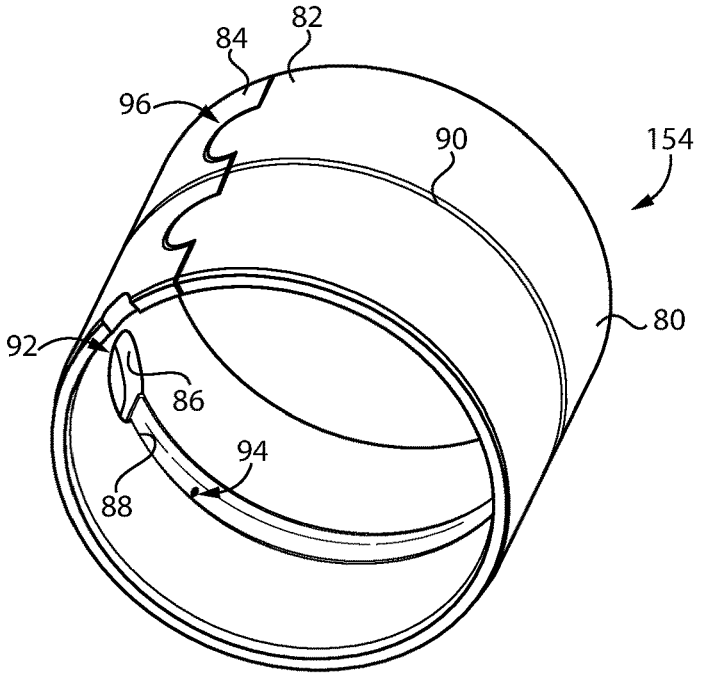
FIG. 10 is a diagrammatic view of a bushing for a lifter arm assembly, according to one embodiment.
Figure 11:
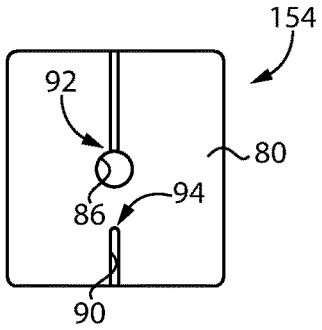
FIG. 11 is another diagrammatic view of the bushing of FIG. 9.
Figure 12:
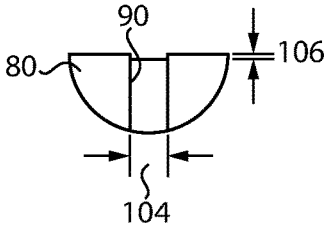
FIG. 12 is a detailed view of a portion of the bushing of FIG. 9.

Turning now to FIGS. 10-12 there is shown a bushing 154 according to one embodiment. Bushing 154 may be similar or identical to bushing 54 discussed above, but is identified with the different reference numeral for convenience. Bushing 154 is structured for providing an oil feed groove 90 that extends circumferentially around a generally cylindrical bushing body 80 between a first groove end 92 and a second groove end 94, defining a circumferential angle less than 360°, and typically between 66° and 360°. Bushing body 80 can be formed from a rolled, generally flat piece of metallic stock having a first end 82 and a second end 84 joined at a coupling 96. Coupling 96 could be formed by a clinch butt joint, for example, or by any other suitable geometry. An opening 86 is formed in bushing body 80 and is structured to feed oil from between bushing 154 and a pin as discussed herein to between bushing 154 and a lifter arm body as also discussed herein. Opening 86 thus enables a flow of oil from a peripheral and circumferential groove 88, circumferential of bushing body 80, to be fed to oil feed groove 90, and provides oil for lubrication between bushing 154 and a pin generally analogous to the configuration in lifter arm assembly 24. FIG. 12 illustrates dimensional attributes of oil feed groove 90 in bushing body 80, and it can be seen that oil feed groove 90 has a width dimension 104 and a depth dimension 106. Width dimension 104 is greater than depth dimension 106. In a practical implementation strategy, desired oil flow may be obtained where a ratio of width dimension 104 to depth dimension 106 is in a range from 2:1 to 8:1. In a refinement, the ratio of width dimension 104 to depth dimension 106 is from 3.5:1 to 6:1. It should also be appreciated that the dimensional and proportional attributes associated with oil feed groove 90 could be similar or identical to such attributes where an oil feed groove is formed in a lifter arm, or formed in part in a lifter arm and in part in a bushing. In the illustrated embodiment oil feed groove 90 would be understood to define a circumferential angle from first groove end 92 to second groove end 94 that is between 66° and 360°. A bushing may also be configured according to the present disclosure to provide a short path oil feed groove where a circumferential angle defined between a first groove end and a second groove end would be between 34° and 66°.

INDUSTRIAL APPLICABILITY

Referring to the drawings generally, when engine system 10 is operating a mixture of fuel and air is combusted in cylinder 14 to cause piston 16 to move between its top dead center position and bottom dead center position to rotate a crankshaft in a generally conventional manner. Rotation of the crankshaft will cause camshaft 22 to rotate, typically at one-half engine speed, to reciprocate lifter arm assembly 24 based upon the contact between roller 34 and cam lobe 23. When lifter arm 26 lifts, pushrod 27 is urged upwardly to open engine valve 18 by way of rocker arm 25, and when lifter arm 26 drops pushrod 27 moves back down with lifter arm 26. Oil is supplied into incoming oil passage 58 as discussed herein, then flows into and around an interface between bushing 54 and pin 52, then travelling by way of oil feed groove 72 to oil spray outlet 68. The oil is sprayed according to spray path 70 to contact cam lobe 23. The rotation of cam lobe 23 with camshaft 22 in contact with roller 34 forms a lubricating film of oil between the contacting components. As suggested above, the provision of a film of lubricating oil directly in this general manner tends to reduce or eliminate momentary slowing or stopping of rotation between the components, or accelerations or decelerations that can cause the interfacing surfaces to slip against one another and scuff.

As also noted above, utilizing one or more of the bushing or lifter arm itself to provide an oil feed pathway creates a labyrinthine flow path upstream of the oil spray port. The labyrinthine design enables the flow rate of the oil jet to be adjusted and controlled. Too high a flow can cause too much of a reduction in oil pressure and/or consumption, whereas too little flow may be insufficient to provide suitable lubrication. The size of the oil feed groove that is employed as well as the length of the groove path traversed to feed the oil spray port can be varied to obtain a desired flow rate, having advantages over an effort to control flow rate by hole or port size alone given challenges as to manufacturability of hole diameters, which in lifter arm assemblies according to the present disclosure may be less than 1 millimeter, at least respecting inlet port 66.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine valve actuation system comprising:

a rotatable camshaft including a cam lobe; and a lifter arm assembly including:

a lifter arm having a roller end and a pin end, the roller end in contact with the cam lobe via a roller, and the pin end defining a pin bore configured to receive a pin extending through the pin bore via a bushing so as to journal the lifter arm upon the pin as rotation of the cam lobe lifts the roller end;

an incoming oil passage extending radially through the pin to the pin bore; and an outgoing oil passage extending radially through the lifter arm from the pin bore so as to form an oil spray port at an outer surface of the pin end, the oil spray port defining an oil spray path oriented towards at least one of the roller or the cam lobe;

wherein at least one of the lifter arm or the bushing includes an oil feed groove formed between an inner surface of the pin end and an outer surface of the bushing so as to fluidly connect the incoming oil passage to the outgoing oil passage.

2. The system of claim 1 wherein the oil feed groove extends in an arc between a first angular location and a second angular location of the at least one of the lifter arm or the bushing.

3. The system of claim 2 wherein:

the bushing further includes an inner circumferential groove configured to connect the incoming oil passage to the oil feed groove; and the oil feed groove defines a groove path that is less than 360° in arc length.

4. The system of claim 3 wherein the groove path is greater than 34° in arc length.

5. The system of claim 4 wherein the oil spray path is oriented towards the cam lobe.

6. The system of claim 3 wherein the oil feed groove is formed in the inner surface of the pin end.

7. The system of claim 3 wherein the oil feed groove is formed in the outer surface of the bushing.

8. The system of claim 3 wherein the oil feed groove defines a depth dimension extending in a radial direction of the pin bore, and a width dimension that is greater than the depth dimension.

9. The system of claim 8 wherein a ratio of the width dimension to the depth dimension is in a range from 2:1 to 8:1.

10. A lifter arm assembly for an engine valve actuation system, the lifter arm assembly comprising:

a lifter arm including:

a roller end having a roller mounted in a fork, the roller configured to contact a cam lobe of a rotatable camshaft;

a pin end defining a pin bore configured to receive a pin via a bushing fixed to the pin and which supports the lifter arm as rotation of the cam lobe lifts the roller end; and an outgoing oil passage extending radially through the lifter arm from the pin bore;

wherein the outgoing oil passage includes an inlet port opening at an inner surface of the pin end, and an oil spray port opening at an outer surface of the pin end so as to define an oil spray path oriented towards at least one of the roller or the cam lobe; and wherein at least one of the lifter arm or the bushing includes an oil feed groove formed between the inner surface of the pin end and an outer surface of the bushing, the oil feed groove fluidly connected to the outgoing oil passage.

11. The lifter arm assembly of claim 10 wherein:

the oil feed groove extends in an arc between a first angular location and a second angular location of the at least one of the lifter arm or the bushing; and the oil feed groove defines a groove path that is less than 360° in arc length.

12. The lifter arm assembly of claim 11 wherein the groove path is greater than 34° in arc length.

13. The lifter arm assembly of claim 12 wherein the oil feed groove is formed in the inner surface of the pin end.

14. The lifter arm assembly of claim 12 wherein a size of the oil spray port is larger than a size of the inlet port.

15. The lifter arm assembly of claim 12 wherein:

the oil feed groove defines a depth dimension extending in a radial direction of the pin bore, and a width dimension that is greater than the depth dimension; and a ratio of the width dimension to the depth dimension is in a range from 2:1 to 8:1.

16. The lifter arm assembly of claim 15 wherein the groove path is less than 66° in arc length, and the ratio of the width dimension to the depth dimension is in a range from 3.5:1 to 6:1.

17. The lifter arm assembly of claim 12 wherein the outer surface of the bushing is interference-fitted with the inner surface of the pin end, and the oil feed groove is formed in the outer surface of the bushing.

18. A lifter arm for an engine valve actuation system, the lifter arm comprising:

a lifter arm body including:

a roller end having a roller mounted in a fork, the roller configured to contact a cam lobe of a rotatable camshaft;

a pushrod lifter having an arcuate rod-contact surface and an upwardly projecting wall extending circumferentially around the arcuate rod-contact surface;

a pin end defining a pin bore;

a connecting section extending between the roller end and the pin end; and an outgoing oil passage located at the pin end, the outgoing oil passage extending through the lifter arm body in a radially outward direction from the pin bore and including an oil inlet port opening at an inner surface of the pin end and an oil spray port opening at an outer surface of the pin end.

19. The lifter arm of claim 18 wherein the inner surface of the pin end further includes a circumferentially extending oil feed groove that defines a groove path that is less than 360° in arc length.

20. The lifter arm of claim 19 wherein the groove path is between 34° and 66° in arc length.

* * * * *